US005683126A

United States Patent [19]

De Vivo et al.

[11] Patent Number: 5,683,126

[45] Date of Patent: Nov. 4, 1997

[54] DUAL LOCKING ASSEMBLY FOR A CONTAINER

[75] Inventors: Mario De Vivo, Newtown; Mariano Tucciarone, Stamford, both of Conn.

[73] Assignee: De Vivo Industries, Newtown, Conn.

[21] Appl. No.: 618,065

[22] Filed: Mar. 25, 1996

[51] Int. Cl.[6] ..... E05C 3/02

[52] U.S. Cl. ..... 292/230; 292/231; 292/210; 220/315; 220/908

[58] Field of Search ..... 292/230, 231, 292/210, DIG. 22; 220/315, 908

[56] References Cited

U.S. PATENT DOCUMENTS

| | | | |
|---|---|---|---|
| 3,642,314 | 2/1972 | Smith et al. | 292/134 |
| 4,155,584 | 5/1979 | Pracchia | 294/73 |
| 4,182,530 | 1/1980 | Hodge | 294/73 |
| 4,363,588 | 12/1982 | Stickney | 414/408 |
| 4,739,896 | 4/1988 | Moss | 292/18 |
| 4,955,501 | 9/1990 | Hodge | 220/315 |
| 5,015,021 | 5/1991 | Wyson et al. | 292/230 |
| 5,042,856 | 8/1991 | Goodman | 292/259 |
| 5,085,341 | 2/1992 | Hodge | 220/331 |
| 5,090,753 | 2/1992 | Goodman | 292/230 |
| 5,094,358 | 3/1992 | Serio, Jr. | 220/315 |
| 5,094,487 | 3/1992 | Drewry | 292/237 |
| 5,118,000 | 6/1992 | Howell et al. | 220/315 |
| 5,149,153 | 9/1992 | Drewry et al. | 292/104 |
| 5,201,434 | 4/1993 | De Vivo et al. | 220/315 |
| 5,224,744 | 7/1993 | Michelutti | 292/234 |
| 5,360,132 | 11/1994 | Edelhoff | 220/908 |
| 5,415,314 | 5/1995 | McCollum | 220/315 |
| 5,474,341 | 12/1995 | Putman et al. | 220/315 |

*Primary Examiner*—Steven N. Meyers
*Assistant Examiner*—Stephen J. Pentlicki
*Attorney, Agent, or Firm*—David P. Gordon; David S. Jacobson

[57] ABSTRACT

The dumpster dual locking assembly includes a housing having two side walls each having an opening. Extending through the openings is a rotatable sleeve which has at one end a flange with a hole for receiving the barrel of a padlock. A rotation bar, which also has at one end a flange with a hole for receiving the barrel of a padlock, extends through and is rotatable relative to the sleeve. A locking bar for securing the hinged lid of a dumpster is coupled to the rotation bar. Both the sleeve and the rotation bar can be manually locked together by placing a lock through their flanges. When the dumpster is upright, a gravitational lock prevents the sleeve from rotating in the housing. The gravitational lock includes a support fixed to the sleeve, a pendulum supported at one end by and rotatable relative to the support, and a latch. The latch locks into a catch mounted on the interior surface of the housing when the dumpster is upright. When the rotation bar and the sleeve are locked together, and when the dumpster is upright, the locking bar is unable to rotate off the hinged lid. However, when the dumpster is tilted forward for emptying, the latch escapes the catch and the locking bar, disposed to forward rotation, can rotate with the sleeve, thereby automatically rotating the locking bar off of the hinged lid.

19 Claims, 7 Drawing Sheets

DUAL LOCKING ASSEMBLY FOR A CONTAINER

BACKGROUND OF THE INVENTION

1. Field of the Invention

This invention relates broadly to the field of locking assemblies for commercial trash bins. More particularly, this invention relates to locking assemblies for dumpsters having hinged lids which are filled in a upright position and tilted from upright to be emptied.

2. State of the Art

Various large trash receptacle containers, also known as dumpsters, are common. In many instances it is preferable to rent dumpsters from a trash removal service. When the dumpster becomes full, the service will come to the dumpsters and empty them. Many trash removal services utilize mechanized trash removal systems whereby a trash removal vehicle comes to the dumpster, lifts the dumpster over the vehicle, and tilts the dumpster so that the hinged lid of the dumpster opens and so that the trash falls into the vehicle where it is compacted. The dumpster is then returned to its upright position on the ground and the lid closes.

Dumpsters are not available free of charge. Nor is the emptying service free. Rather the frequent emptying of a dumpster is a significant expense. This expense is increased when unauthorized persons deposit trash into the dumpsters requiring even more frequent emptying.

In addition, there have been several instances of an unauthorized person entering a dumpster and becoming injured or killed when a removal service unknowingly lifted the dumpster with the person therein, emptied the dumpster, and compacted the trash with the person therein.

As a result of potential unauthorized use, many dumpsters utilize locking assemblies to prevent the lid from being opened by unauthorized persons. Generally, such locking assemblies are dual operating, permitting the dumpster lid to be locked and unlocked manually by an authorized person, for example, by lock and key, and also by an automatic lock which releases when the dumpster is lifted and inverted even when the manual lock is activated. For example, U.S. Pat. No. 4,182,530 to Hodge discloses a lid locking assembly which uses the dumpster's own weight to operate a release of the lid when the dumpster is inverted. U.S. Pat. No. 4,363,588 to Stickney shows another assembly which releases a latch assembly when the fork lift tines of the trash removal truck are inserted into receiving sleeves. The release of the latch permits the hinged front of the container to swing free allowing the trash to be released. However, the locking assemblies of Hodge and Stickney are expensive and not retrofitable to existing dumpsters without significant modification of the dumpsters.

More recently, retrofitable and less expensive locking assemblies have become available. Co-owned U.S. Pat. No. 5,201,434 discloses a side-mounted dumpster locking assembly which can be retrofit to existing dumpsters. However, a side locking assembly decreases the number of positions in which a dumpster can be placed, as the dumpster will not be able to abut a wall on the side on which the lock is located. If the lock abuts a wall, authorized persons will not be able to manually unlock the assembly and allow the lid to be opened. A front lock enables the dumpster to be positioned with greater freedom. Therefore it is preferable to have a locking assembly which can be located on the front of a dumpster.

U.S. Pat. No. 5,474,341 to Putman discloses a front mount locking assembly using two sloped railings, a roller bar, and an L-shaped locking bar attached to a locking lever. When the dumpster is upright, the roller bar is gravitationally pulled toward the lower portion of the sloped railings. In this position, the roller bar prevents the lock lever from rotating upward and keeps the locking bar from moving off of the lid of the dumpster. The locking bar prevents the dumpster lid from being opened by an unauthorized person. When a dumpster using this locking assembly is tilted forward, the roller bar rolls along the railings, moving out of the path of the locking lever and the lid opens, However, there are some disadvantages to the lock disclosed by Putman. First, the dumpster is required to be on fairly level ground. Otherwise the roller bar may never roll into the locked position and the dumpster lid will remain in the unlocked position. Second, it requires a complicated internal construction with sloped railing in proper alignment. Third, this locking assembly requires a substantial length of the sloped railings for the roller bar to roll out path of the locking lever. The requirement of a substantial length for the railings places a limit on the smallest size to which the Putman lock can be manufactured and Still perform its locking function. This is disadvantageous, as a lock which protrudes substantially from the front of the dumpster requires more space for dumpster placement, as well as adds to the possibility of injury resulting from the protrusion.

U.S. Pat. No. 5,094,358 to Serio discloses another front mounted locking assembly. In Serio, a "wedge" device rotates or rolls out of the way when the dumpster is substantially tilted, and thereby releases a swing lever to unlock the dumpster. However, this lock has two drawbacks. First, when tilting forward the dumpster must be tilted approximately ninety degrees before the dumpster lid automatically unlocks, and it is not always preferable to tilt the dumpster so much before having the lid unlock. Second, Serio's locking assembly will unlock when the dumpster is tilted backward. It is preferable to have a dumpster lid release only upon forward tilt, as only forward tilt, and not backward tilt, is done by the trash removal vehicle when emptying the dumpster. Furthermore, backward tilting motion applied to the dumpster would be likely to only occur in the event of a mishap. In such a situation it would be preferable to have the hinged lid remain in closed position.

SUMMARY OF THE INVENTION

It is therefore an object of the invention to provide a front mounted dual locking assembly for a dumpster.

It is another object of the invention to provide a front-mounted dual locking assembly for a dumpster wherein a first lock can be manually opened by an authorized user when the dumpster is in an upright position and a second lock will be automatically unlocked when the dumpster is tilted forward.

It is a further object of the invention to provide a front-mounted gravity activated release for the automatic lock on a dual locking assembly.

It is an additional object of the invention to provide a front-mounted dual locking assembly for a dumpster which can be manufactured to small dimensions.

It is also object of the invention to provide a dual locking assembly which is easy and inexpensive to manufacture.

A further object of the invention is to provide an improved dual locking assembly which can be originally fit or retrofit on dumpsters.

Another object of the invention is to provide an automatic locking assembly for a dumpster which does not unlock when the dumpster is tilted backward.

It is still another object of the invention to provide a front-mounted locking assembly for a dumpster which will automatically unlock when the dumpster is tilted approximately forty-five degrees forward.

In accord with these objects which will be discussed in detail below, the dual locking assembly of the present invention has a manual locking assembly which can only be opened by an authorized user and an automatic lacking assembly which is released by gravity when the dumpster to which the lock is attached is tilted forward. The locking assembly is front mounted on a dumpster, permitting easy access to the lock, has a very small profile, has few parts, and is very inexpensive and easy to manufacture.

More particularly, the dumpster dual locking assembly includes a housing for attachment to a dumpster. The housing has two side walls with each wall having an opening. Extending through the openings is a sleeve, which is rotatable relative to the housing, and which has at one end a flange with a hole for receiving the barrel of a padlock. A rotation bar, also having at one end a flange with a hole for receiving the barrel of the padlock, extends through and is rotatable relative to the sleeve. The sleeve and the rotation bar can be manually locked together by placing the barrel of a padlock through their respective flanges. A locking bar, which secures the hinged lid of the dumpster, is rigidly connected to the rotation bar by an L-shaped arm, thereby situating the locking bar and the rotation bar parallel to each other. A gravitational lock is provided in the housing and includes a pendulum latch assembly fixed but rotatable relative to the sleeve, and a catch fixed to the housing. The catch acts as a stop for the latch when the dumpster is upright.

When the dumpster is in an upright position and when the sleeve and the rotation bar are not locked together by the padlock, the rotation bar freely rotates in the sleeve even though the sleeve is prevented from rotating by the gravitational lock. Thus the locking bar which is rigidly connected to the rotation bar may be lifted off the dumpster lid. When the dumpster is in an upright position and the sleeve and rotation bar are manually locked together, the locking bar is unable to rotate inside the sleeve. In addition, the sleeve is prevented from rotating in the housing because of the gravitational lock. However, when the dumpster is tilted forward for emptying, the latch remains vertical due to gravity and escapes the catch, allowing the manually locked sleeve and rotation bar to rotate together in the housing. This rotation enables the locking bar to move off of the hinged lid of the dumpster, thereby permitting the dumpster lid to open.

With the provided arrangement the following advantages are attained: only authorized users will have access to the interior of the dumpster, the lock will automatically release when the dumpster and lock are tilted forward, and the lock will not unlock when tilted backward. In addition, the lock can be front mounted to a dumpster, can be built to a have a slim profile because the dimensions for the parts within the invention can be relatively small, and can be easily retrofit to a variety of dumpsters.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
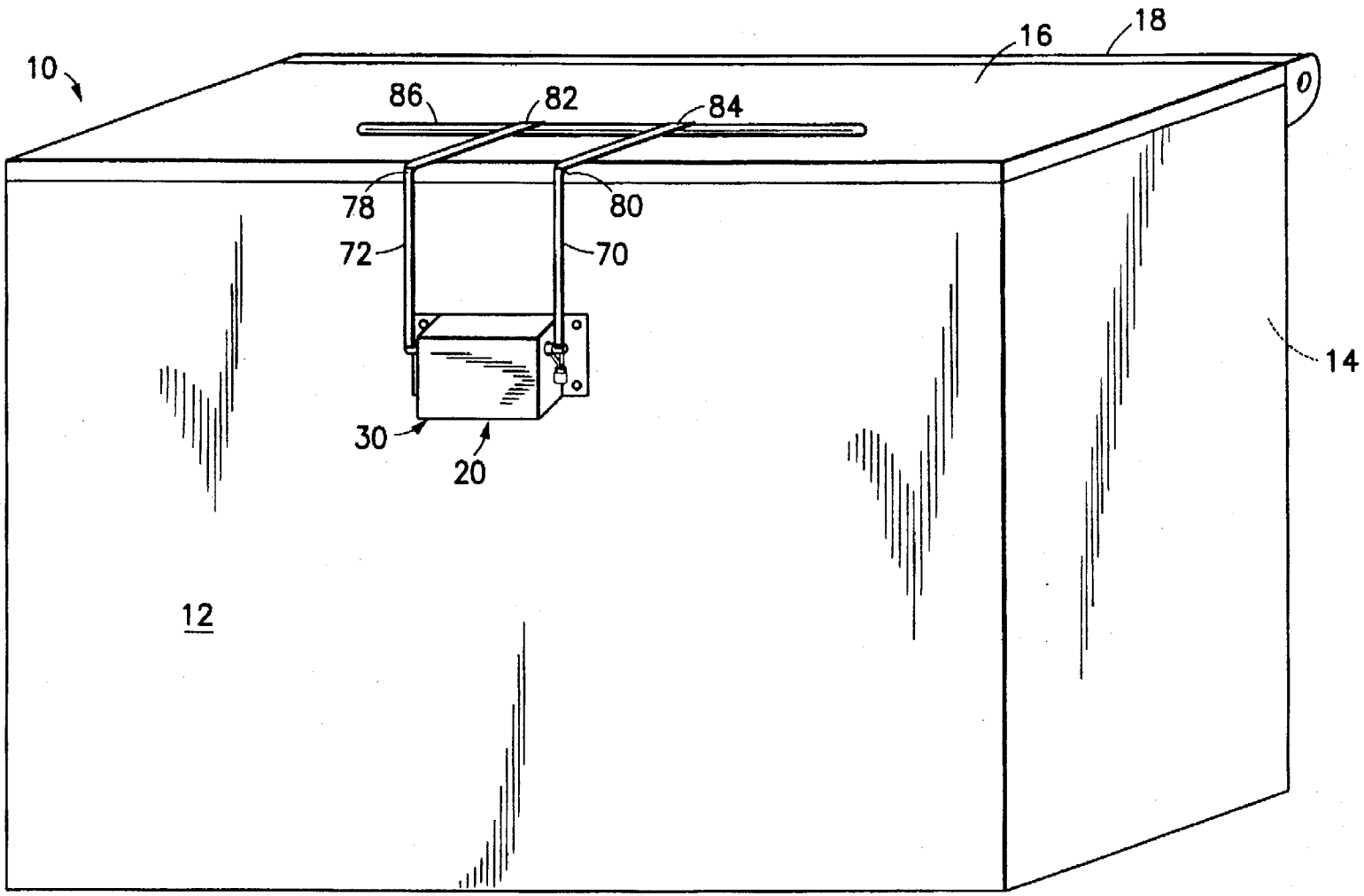
FIG. 1 is a perspective view of a dumpster incorporating the dual locking assembly of the invention.

Turning now to FIG. 1, a common trash bin or dumpster is shown. Dumpster 10 is provided with a front surface 12, a rear surface 14, and a lid 16 hinged by a hinge 18 to the rear surface 14. The hinge 18 permits the lid 16 to open at the front and provides access to the inside compartment of the dumpster.

Figure 2:
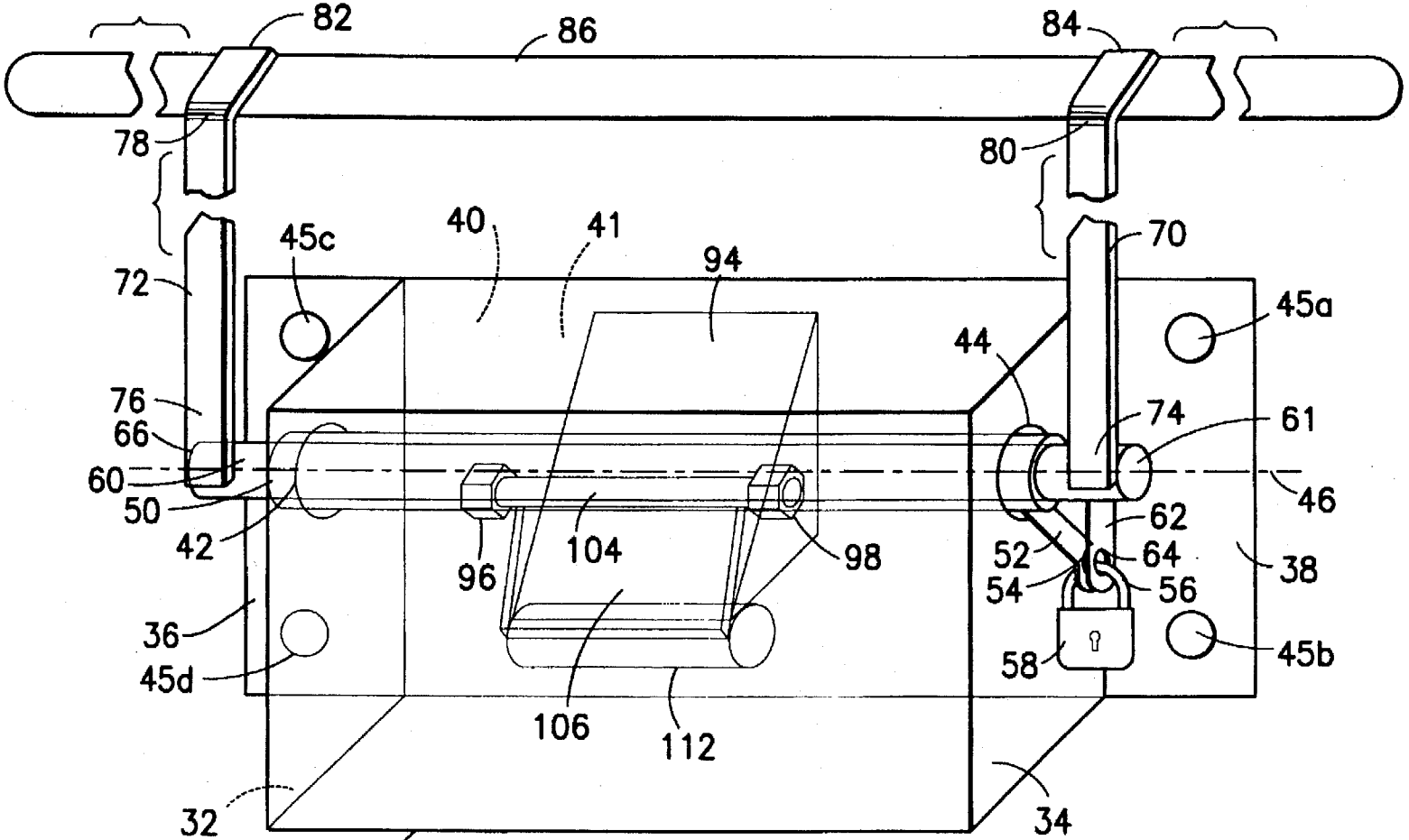
FIG. 2 is a transparent perspective view of the dual locking assembly of the invention.
Figure 3:
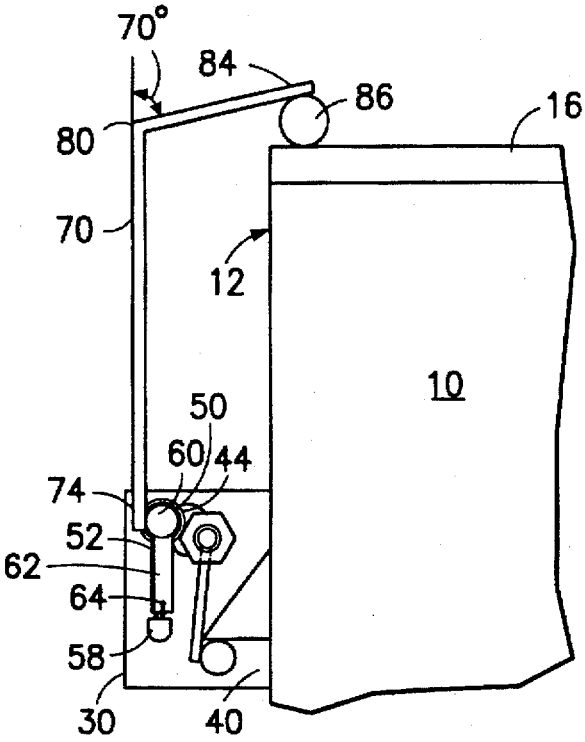
FIG. 3 is a transparent side view of a portion of a dumpster and the dual locking assembly of this invention.

Referring now to FIGS. 2 and 3, the dual locking assembly 20 of the present invention is contained within a housing 30 having two side walls 32, 34, two extensions 36, 38 and a rear wall 40 having an interior surface 41. Each extension 36, 38 is preferably riveted by rivets 45*a*, 45*b*, 45*c*, 45*d* to the front surface 12 of the dumpster to secure the housing 30 on the dumpster. Each side wall 32, 34 has an opening 42, 44 for receiving a sleeve 50. Sleeve 50 extends through both side wall openings 42, 44 and is supported loosely such that it may rotate about an axis 46. One end of the sleeve terminates in a flange 52 which includes a hole 54 for receiving the barrel 56 of a padlock 58.

A rotation bar 60 extends through the sleeve 50. One end 61 of the rotation bar 60 has a flange 62 which includes a hole 64 for receiving the barrel 56 of a padlock 58. Both flange 52 and flange 62 are outside the same side wall 34 of the housing 30. It will be appreciated that having both flanges 52, 62 outside the same side wall 34 will enable flanges 52, 62 to be aligned to receive the same barrel 56 of the padlock 58.

A pair of L-shaped arms 70, 72 are welded at first ends 74, 76 to the ends 64, 66 of the rotation bar 60. Arms 70, 72 rise vertically from the rotation bar 60 until level with the height of front surface 12 and then bend approximately 70° at 78, 80 toward the rear 14 of the dumpster 10 until the arms 70, 72 are behind the plane of the front surface 12 of the dumpster. Welded to second ends 82, 84 of the arms 70, 72 is a locking bar 86 which extends substantially across the lid 16 and is parallel to the rotation bar 60. It will be appreciated that when the rotation bar 60 is prevented from rotating within the sleeve 50 or when the sleeve 50 is prevented from rotating within the housing 30, the locking bar 86 will be prevented from moving off the lid 16 and the lid 16 of the dumpster 10 will be secured in a closed position.

Figure 4:
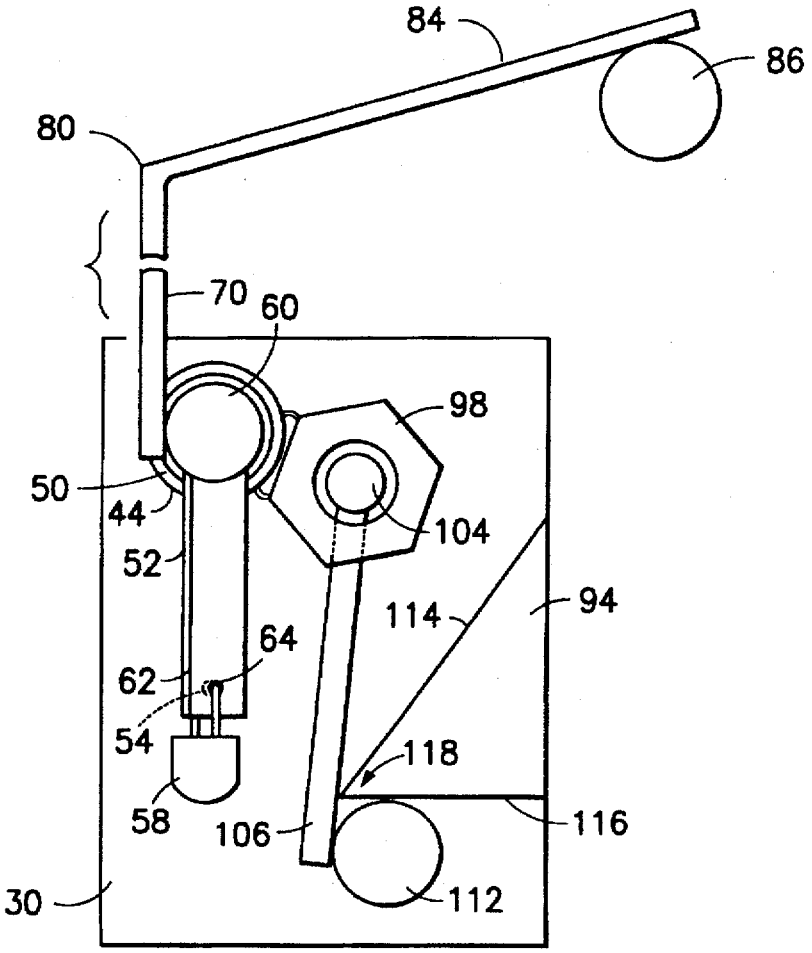
FIG. 4 is a partially broken transparent actual size side view of the dual locking assembly of the invention, with the dumpster in an upright position.
Figure 5:
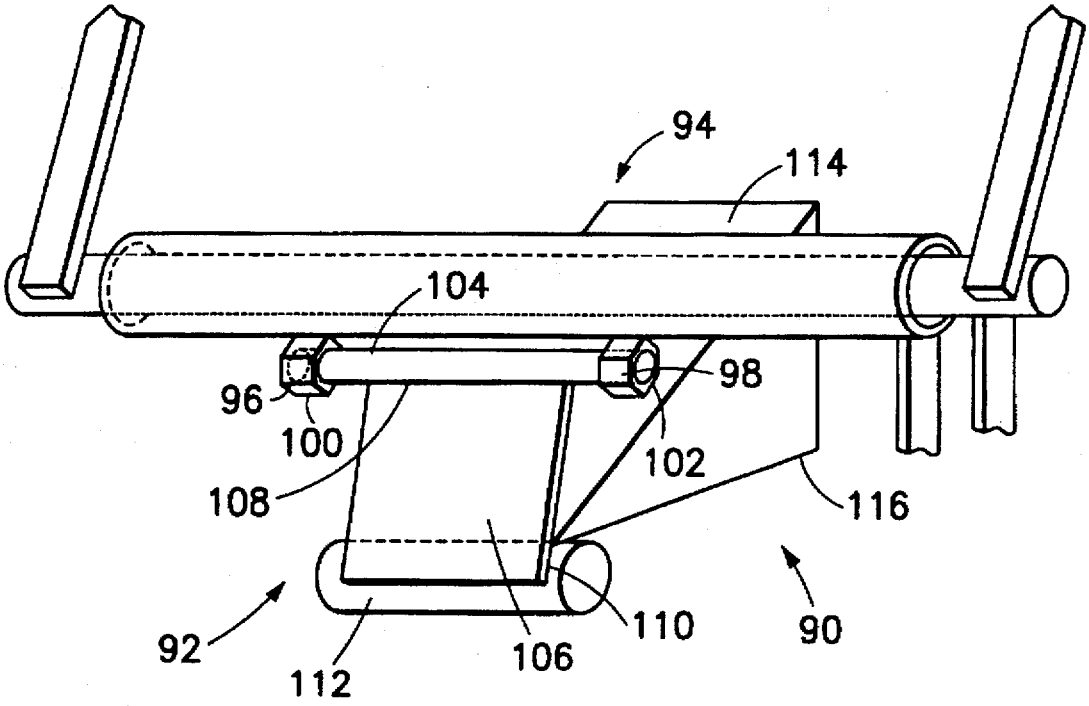
FIG. 5 is a perspective view of the gravitational lock assembly of the invention.

As seen best in FIG. 4, when the barrel of a padlock is received within holes 54, 64 of flanges 52, 62, the rotation bar 60 is prevented from rotating within the sleeve 50. Also when the dumpster is in an upright position, a gravitational lock 90, shown generally in FIG. 5, prevents the sleeve 50 from rotating within the housing, and thereby prevents the rotation bar 60 from rotating with the sleeve 50. The gravitational lock 90 includes two interacting portions: a pendulum latch assembly 92, and a wedge-shaped catch 94. The pendulum latch assembly 92 includes two supports 96, 98 each with a throughbore 100, 102, a support rod 104, a flattened pendulum 106 and a round latch 112. The support rod 104 extends into the throughbores 100, 102 and is rotatably held by the supports 96, 98. Welded to the support rod 104 is the upper end 108 of the flattened pendulum 106. The round latch 112 is welded adjacent to the lower end 110 of the pendulum 106 on the housing rear wall side of the pendulum. The supports 96, 98 are welded to the rear side of the sleeve 50.

The wedge-shaped catch 94 is provided with a sloping surface 114 and a lower substantially horizontal surface 116. The catch 94 is welded to the interior surface 41 of the rear wall 40 of the housing 30 such that a shallow clearance is provided between the horizontal surface 116 and the top of the round latch 112 when the pendulum 106 rests against the corner portion 118 of the catch 94. As seen in FIG. 4, when the dual locking assembly is in an upright position, the round latch 112 will rest under the horizontal surface 116 of the catch 94. If the rotation bar 60 and the sleeve 50 are locked together, any attempt to move both together will be prevented as the round latch 112 will lock under the horizontal surface 116 of the catch 94, preventing upward movement of the latch 112, and thereby preventing rotation of the rotation bar 60 and the sleeve 50 together.

Figure 6A:
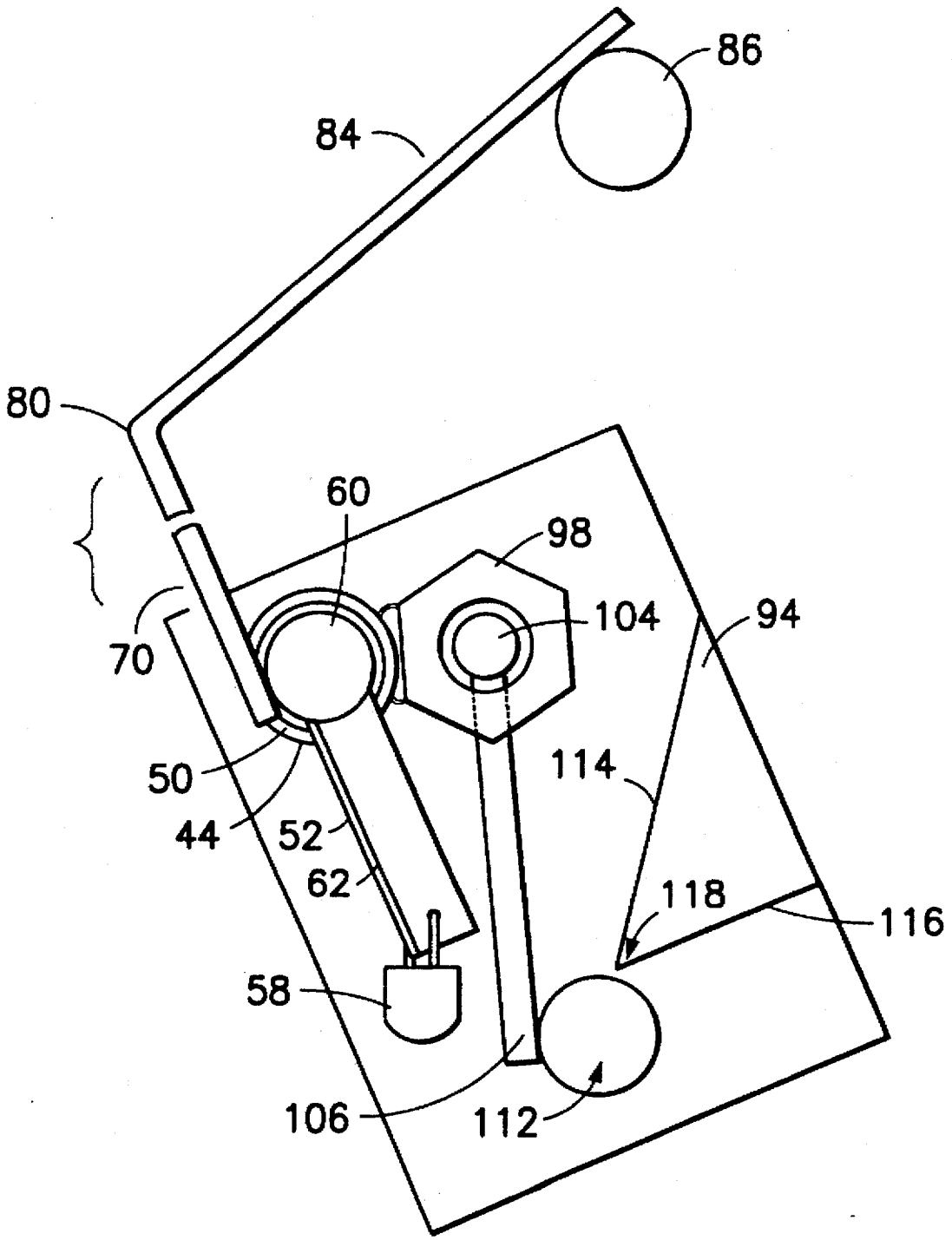
FIG. 6*a* is an actual size partially transparent side view of the dual locking assembly of the invention, when the dumpster is tilted forward.
Figure 6B:
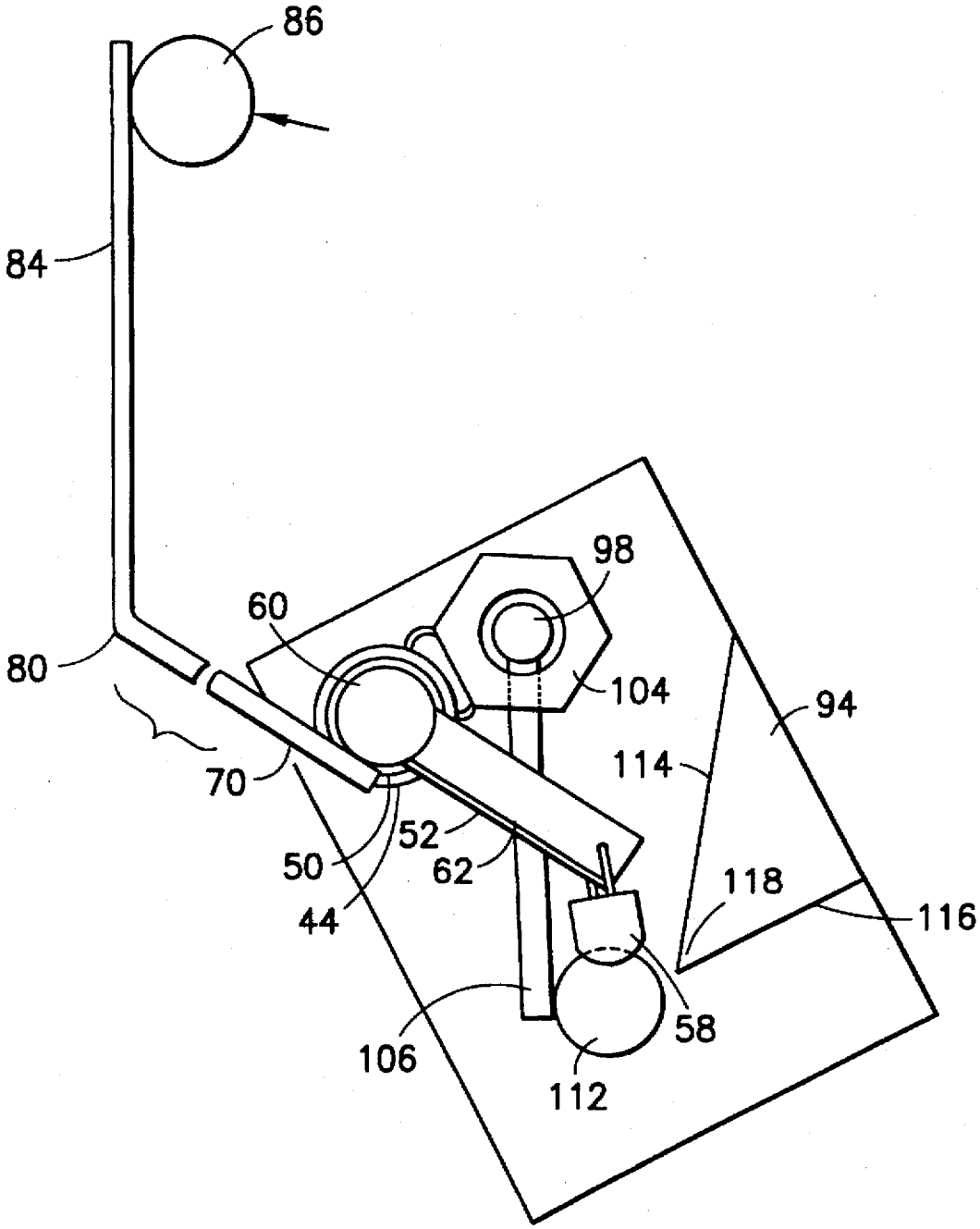
FIG. 6*b* is an actual size partially transparent side view of the dual locking assembly of the invention, when the dumpster is tilted forward with the gravitational lock in an open position.

As shown in FIGS. 6*a* and 6*b*, when a dumpster is tilted forward for emptying, the locking bar 86 is disposed due to gravity to rotate forward off the hinged lid 16. In particular, as the dumpster is tilted forward, the round latch 112, due to gravity and the ability of the support rod to rotate in the supports 96, 98, remains vertical and escapes from underneath the horizontal surface 116, and will eventually substantially clear the corner portion 118. Once the round latch 112 has substantially cleared the corner portion 118, the rotation bar 60 and the sleeve 50 will rotate together (the sleeve 50 rotating in the housing), and the locking bar 86 will move forward from its locked position into an open position and thereby release the hinged lid 16 of the dumpster 10, allowing the trash to empty.

Figure 6C:
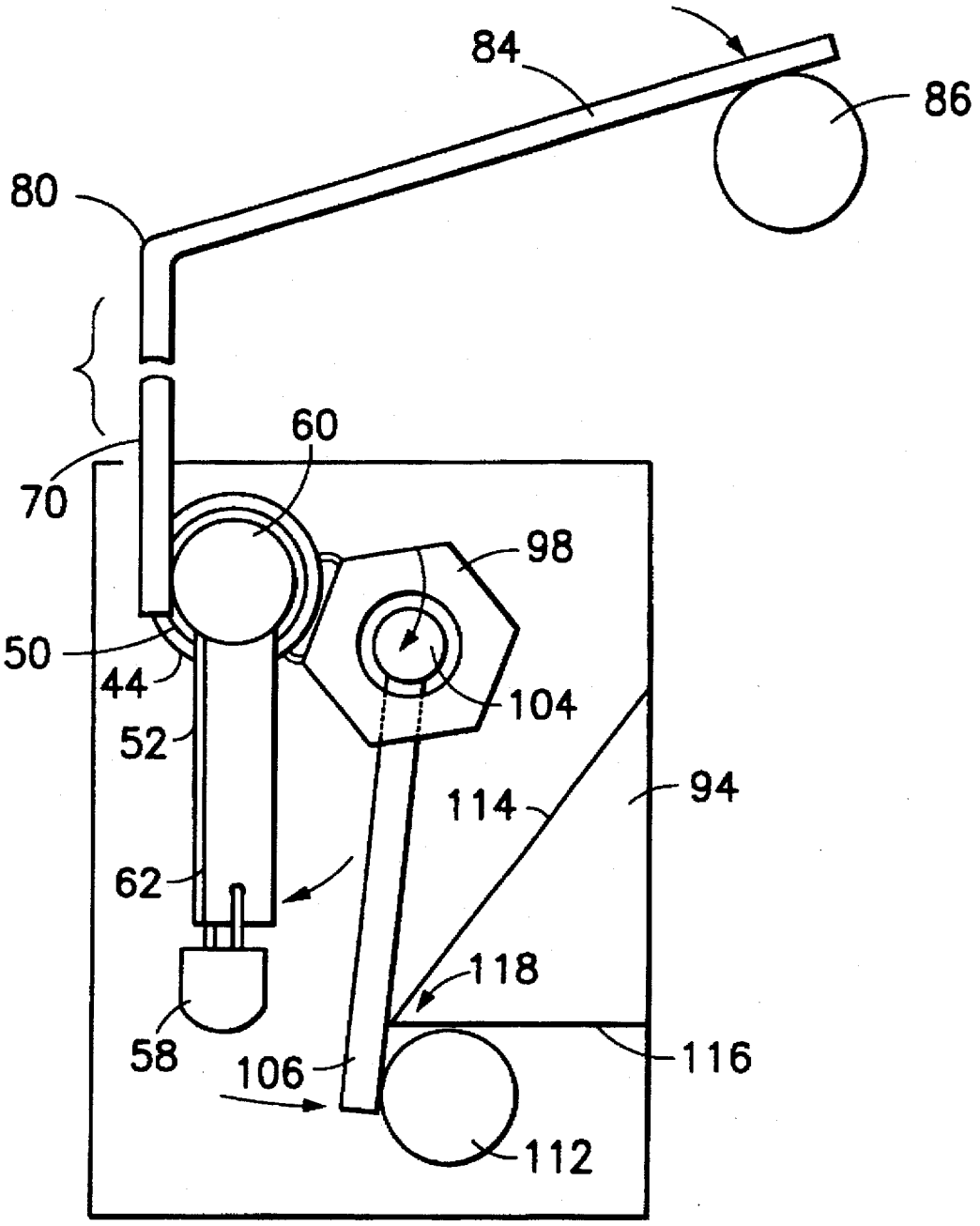
FIG. 6*c* is an actual size partially transparent side view the dual locking assembly of the invention, with the dumpster returned to an upright position and the gravitational lock engaged in a locked position.

As is shown in FIG. 6*c* when the dumpster 10 is returned to its upright position from its forward tilted position, the locking bar 86 will be disposed by gravity to move backward, with the sleeve 50 rotating in the housing. As the sleeve 50 rotates, the attached pendulum latch assembly 92 moves downward, with the round latch 112 moving along the sloped surface 114 until clearing the corner portion 118. The latch 92 then freely swings into a resting position underneath the horizontal surface 116 of the catch 94.

There have been described and illustrated herein a dual locking assembly for a dumpster. While particular dimensions for parts have not so far been disclosed, it is appreciated that many of the parts shown in the preferred embodiment can be obtained inexpensively and easily as a result of using standard parts and/or sizes. For example, the sleeve is preferably made from 1 inch tubular pipe of 18 inch length, the rotation bar is preferably made from ¾ inch round pipe of 20 inch length, the locking bar 86 is preferably made from ¾ inch round pipe of 55 inch length, supports 96, 98 are preferably standard ⅝ inch nuts, the support rod 104 is preferably made from ½ inch round pipe of 3 inch length, the round latch 112 is preferably made from 1 inch round pipe of 2¾ inch length, and the housing is preferably a 16 inch by 3 inch by 5 inch IIGA tub. It is further appreciated that when parts of the preferred sizes are used, the dual lock assembly housing has a small profile, extending only 3 inches from the front surface of the dumpster. However, it is also appreciated that the invention can be made from parts of other sizes or from other parts.

While particular embodiments of the invention have been described, it is not intended that the invention be limited thereto, as it is intended that the invention be as broad in scope as the art will allow and that the specification be read likewise. Thus, while particular methods of coupling specific parts have been disclosed, it will be appreciated that other methods can be used as well. For example, while rivets through the side extensions of the housing is the preferred method for attaching the housing to the dumpster, other methods, such as welding or screws, can be used. In addition, while welding is the preferred method for attaching the locking bar to the L-shaped arms and for attaching various pieces of the pendulum latch assembly together and for attaching the pendulum latch assembly to the sleeve and for attaching the catch to the housing, other methods, for example metal fasteners, can be used. In addition, while flanges on the end of each of the sleeve and the rotation bar are preferable for receiving a lock, other means of receiving a lock can be used, such as a bore through the diameter of a portion adjacent to the end of the rotation bar and holes in the sleeve aligned with the bore, the holes and the bore capable of receiving the barrel of a lock. Furthermore, while it is preferable that two arms be used to couple the locking bar to the rotation bar, it will be recognized that only one arm or more than two arms can be used. Also, while it is preferable to have L-shaped arms, arms of other shapes such as C-shaped, could be used. Moreover, while a wedge-shaped catch is preferable, it will be appreciated that other shaped catches can be used. And, while a flattened pendulum is disclosed, pendulums of other shapes, such as rounded, could also be used. In addition, while the catch is disclosed to be attached to the interior surface of the rear wall of the housing, it will be understood that the catch can be attached to another surface of the housing. Furthermore, though the latch is disclosed as being round, it is understood that the latch may be configured otherwise, such as spherical or rectangular. Still further, while the barrel of a padlock is shown to couple the rotation bar and the sleeve at their respective flanges, it will be further understood that other means for coupling the sleeve and rotation bar can be similarly used. It will therefore be appreciated by those skilled in the art that yet other modifications could be made to the provided invention without deviating from its spirit and scope as so claimed.

We claim:

1. A locking assembly for a dumpster having a front wall and a hinged lid, comprising:

a) a housing having two side walls and an interior surface, each side wall having an opening, said housing adapted for being fixedly attached to the dumpster;

b) a sleeve having two ends extending through and rotatable relative to said openings in said side walls of said housing, having first lock receiving means;

c) a rotation bar extending into and rotatable relative to said sleeve and having second lock receiving means alignable with said first lock receiving means;

d) a locking bar means rigidly coupled to said rotation bar for securing the hinged lid; and e) a gravitational lock including a latch means coupled to and for rotating under force of gravity relative to one of said sleeve and said rotation bar, and a catch means fixedly mounted to said interior surface of said housing for preventing substantial movement of said latch means when the dumpster is upright, wherein when the dumpster is upright and when said first and second lock receiving means are locked together, said rotation bar cannot rotate relative to said sleeve and said sleeve cannot rotate in said housing, and when the dumpster is tilted forward, said locking bar means is gravitationally disposed to rotate forward and said latch means escapes said catch means and said rotation bar and said sleeve are able to rotate together in said housing and thereby permit said locking bar means to rotate off of the hinged lid.

2. A locking assembly according to claim 1, wherein:

said latch means includes a support fixedly attached to said sleeve and a pendulum having a first end and a second end, said first end supported by and rotatable relative to said support, and a latch fixedly attached to said second end of said pendulum.

3. A locking assembly according to claim 2, wherein:

said first lock receiving means further comprises a first flange adjacent to one end of said sleeve, and said second lock receiving means comprises a second flange adjacent to one end of said rotation bar, in which both said first flange and said second flange each include an opening for receiving a barrel of a padlock.

4. A locking assembly according to claim 3, further comprising:

at least one substantially L-shaped arm which rigidly couples said locking bar means to said rotation bar.

5. A locking assembly according to claim 3, wherein:

said housing adapted to extend outward from the front wall of the dumpster at most approximately three inches.

6. A locking assembly according to claim 1, further comprising:

means for fixedly attaching said housing to the front surface of the dumpster.

7. A locking assembly according to claim 1, wherein:

said first lock receiving means further comprises a first flange adjacent to one end of said sleeve, and said second lock receiving means comprises a second flange adjacent to one end of said rotation bar, in which both said first flange and said second flange each include an opening for receiving a barrel of a padlock.

8. A locking assembly according to claim 1, wherein:

said catch means is wedge-shaped.

9. A locking assembly according to claim 1, wherein:

said latch means is cylindrical in shape.

10. A locking assembly according to claim 1, further comprising:

at least one arm which rigidly couples said locking bar means to said rotation bar.

11. A locking assembly according to claim 10, wherein:

said at least one arm is L-shaped.

12. A locking assembly according to claim 1, wherein:

said housing adapted to extend outward from the front wall of the dumpster at most approximately three inches.

13. A dumpster with locking assembly, comprising:

a) a container having a front wall, a back wall, two side walls, and a hinged lid; and b) a locking assembly having 1) a housing having two side walls and an interior surface, each side wall having an opening, said housing fixedly attached to said container, 2) a sleeve having two ends extending through and rotatable relative to said openings in said side walls of said housing, having first lock receiving means, 3) a rotation bar extending into and rotatable relative to said sleeve and second lock receiving means, 4) a locking bar means rigidly coupled to said rotation bar for securing the hinged lid, and 5) a gravitational lock including a latch means coupled to and for rotating under force of gravity relative to one of said sleeve and said rotation bar, and a catch means fixedly mounted to said interior surface of said housing for preventing substantial movement of said latch means when said container is upright, wherein when said container is upright said latch means engages said catch means and when the first and second lock receiving means are locked together, said rotation bar means cannot rotate relative to said sleeve and said sleeve cannot rotate in said housing, and when said container is tilted forward, said locking bar means is gravitationally disposed to rotate forward and said latch means escapes said catch means and said rotation bar means and said sleeve are able to rotate together in said housing and thereby permit said locking bar means to rotate off of said hinged lid.

14. A dumpster according to claim 13, wherein:

said latch means includes a support fixedly attached to said sleeve and a pendulum having a first end and a second end, said first end supported by and rotatable relative to said support.

15. A dumpster according to claim 14, wherein:

said first lock receiving means further comprises a first flange adjacent to one end of said sleeve, and said second lock receiving means comprises a second flange adjacent to one end of said rotation bar, in which both said first flange and said second flange each include an opening for receiving a barrel of a padlock.

16. A dumpster according to claim 15, wherein:

said housing extends outward from the front wall of said container at most approximately three inches.

17. A dumpster according to claim 13, wherein:

said catch means is wedge-shaped, and said latch means is cylindrical in shape.

18. A dumpster according to claim 13, further comprising:

at least one substantially L-shaped arm which rigidly couples said locking bar means to said rotation bar.

19. A dumpster according to claim 13, wherein:

said housing extends outward from the front wall of said container at most approximately three inches.

* * * * *